United States Patent [19]

Sklar

[11] 4,209,936

[45] Jul. 1, 1980

[54] FLYING SAUCER APPENDAGE

[76] Inventor: Paul R. Sklar, 860 Fifth Ave., New York, N.Y. 10021

[21] Appl. No.: 850,478

[22] Filed: Nov. 10, 1977

[51] Int. Cl.[2] ..... A63H 27/00

[52] U.S. Cl. ..... 46/74 D; 244/153 R; 273/424

[58] Field of Search ..... 46/52, 74 D, 74 R, 76 R; 273/106 B; 244/153 R, 153 A, 155 R

[56] References Cited

U.S. PATENT DOCUMENTS

| | | | |
|---|---|---|---|
| 1,009,274 | 11/1911 | Ayling | 244/153 R |
| 1,081,037 | 12/1913 | Hackh | 273/106 B |
| 1,966,895 | 7/1934 | Kuhns | 46/51 |
| 2,524,500 | 10/1950 | Whitehurst | 244/153 R |
| 2,608,655 | 8/1952 | Riemann | 46/76 R X |
| 2,659,178 | 11/1953 | Van Hartesveldt | 46/74 D X |
| 2,744,356 | 5/1956 | Killinger et al. | 46/74 D X |
| 2,903,207 | 9/1959 | Wilson | 244/153 R |
| 3,439,446 | 4/1969 | Alonso | 46/52 |
| 3,545,760 | 12/1970 | Wilson | 273/106 B |
| 3,673,732 | 7/1972 | Liotta | 46/74 D |
| 3,976,297 | 8/1976 | Seymour | 46/74 D |

FOREIGN PATENT DOCUMENTS

| | | | |
|---|---|---|---|
| 429361 | 5/1926 | Fed. Rep. of Germany | 46/51 |
| 820412 | 11/1951 | Fed. Rep. of Germany | 46/74 |

*Primary Examiner*—F. Barry Shay

[57] ABSTRACT

A saucer shaped throwing disc with a flexible tail and pivot means for attaching one end of the tail to the disc at its central vertical axis. When the disc is rotating in flight, the tail trails while remaining extended in the direction opposite the direction of flight. The tail has an aperture near one end for attachment purposes and other apertures which aid in securing the tail in folded or rolled condition.

4 Claims, 12 Drawing Figures

FIG. 1
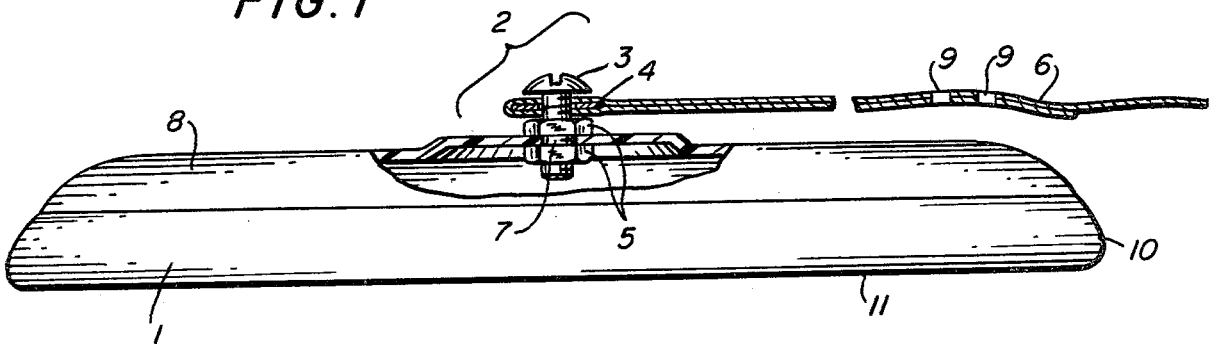
FIG. 1a
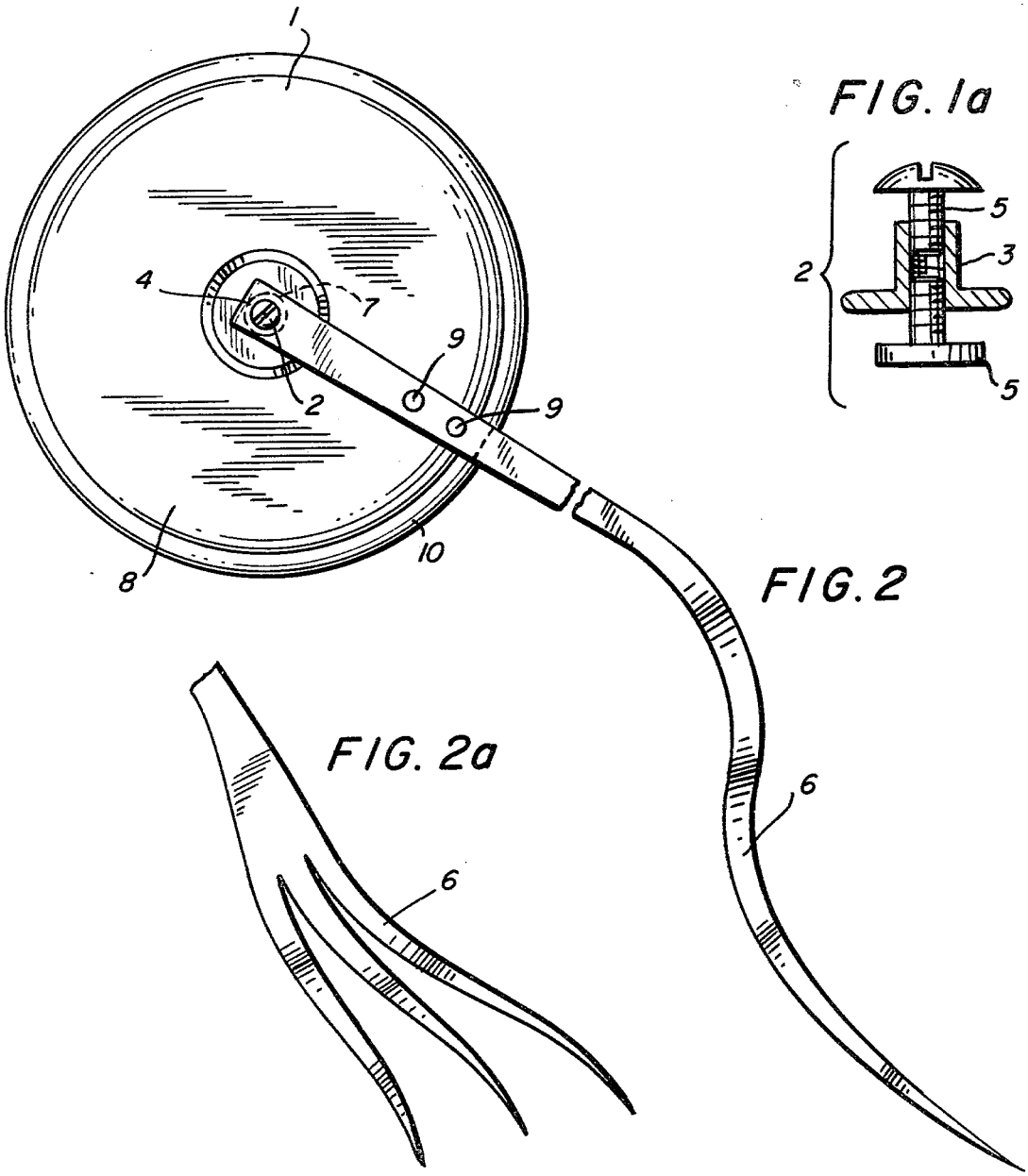
FIG. 2
FIG. 2a

FLYING SAUCER APPENDAGE

SUMMARY

This invention relates to the catch and throw game, more particularly to a catch and throw game in which a saucer shaped disc with a flexible tail and a pivot means for attaching one end of the tail to the disc at its central vertical axis is thrown by one player and is caught and returned by another

BACKGROUND

The instant invention provides an improved version of the widely used flying saucer aerial toy. While improvements have been made in the flight characteristics of such toys, nothing has heretofore been done to help improve the game itself. Palpable results are achieved by the use of this invention, such as enabling a player to find and recover the toy if and when thrown out of sight or reach. Further, the invention will enable the player to adjust his "throw" by using the tail as an indicator of wind direction and velocity. Further, the invention will enable the player to develop his coordination and agility commensurate with his ability to properly throw and catch the toy while the tail is extended. Further, aerodynamic forces cause the tail to osciliate it flies, thereby providing an aesthetically pleasing visual effect.

The toy comprises a disc having a flat circular center circumscribed by a downwardly projecting rim, a tail including at least one streamer of flexible material, and a pivot means for attaching one end of the tail to the disc at its central vertical axis. The disc is to be of a size which can readily be held, thrown and caught by one hand.

Further objects, features and advantages of the invention will become apparent upon consideration of the following detailed description in conjunction with the drawings, in which:

FIG. 1 is a side view of disc with cut away depicting mounted position of tail on disc and cross-sectional view of tail;

FIG. 1*a* is a cross-sectional side view depicting pivot means for attaching tail to disc;

FIG. 2 is a top view depicting mounted position of tail at central vertical axis of the disc and position of holes therein; and top view depicting a tapered tail variation;

FIG. 2*a* is a top view depicting a split tail variation;

FIG. 3 is a perspective view depicting tail in partially folded position;

FIGS. 3*a*, *b*, and *c* are single line conceptualizations depicting methods of folding tail;

FIG. 4 is a perspective view depicting tail in partially rolled position;

FIGS. 4*a*, *b* and *c* single line conceptualizations dipicting methods of rolling tail.

DETAILED DESCRIPTION

Figure 3:
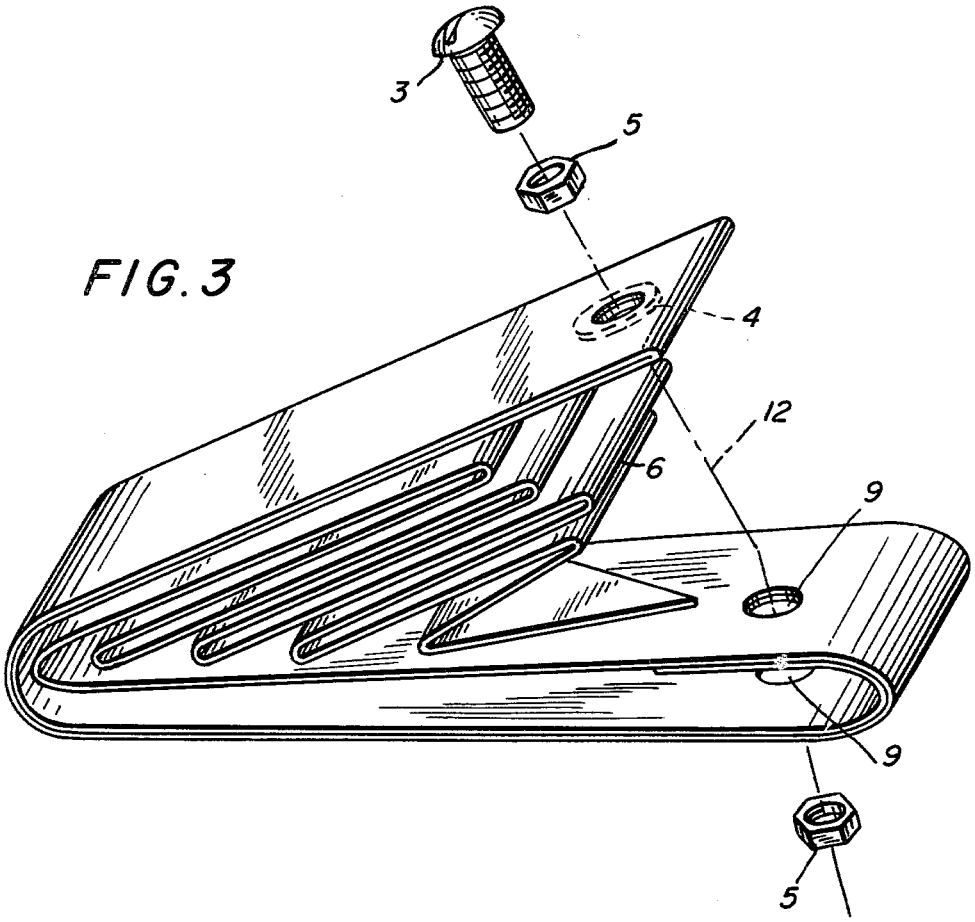

FIG. 1 shows a side view of the saucer shaped throwing disc 1 with its center portion cut away revealing a pivot means 2 comprising post 3, ring 4, and securing components 5. FIG. 1 also shows a cross-sectional view of the tail 6, with a hole located at one end of the tail 6. This hole is reinforced by the ring component 4 of the pivot means 2. The ring component 4 is held between two layers of the material of which the tail 6 is made.

There are two other holes 9 in the tail 6 located near the outer edge 10 of the disc 1.

The tail 6 is attached to the disc 1 by the pivot means 2 when the ring 4 and post 3 components of the pivot means 2 have been coupled. One securing component 5 fixes the ring component 4 and post component 3 together, while another securing component 5 contemporaneously fixes the post component 3, as coupled with the ring component 4, to the disc 1. When the toy is thrown into flight, the pivot means 2 allows the disc 1 to rotate about the central vertical axis 7 of the disc 1 relative to one end of the tail 6, so that the tail 6 trails the disc 1 in the direction opposite the direction of flight.

FIG. 1*a* shows pivot means 2 comprising a post component 3 and securing components 5. The flanged portion of the post component 3 is concentric with the central vertical axis 7 of the disc 1 on its upper surface 8. A securing component 5 of the pivot means 2 extended up through a hole in the disc 1 at its central vertical axis 7 fixes the post component 3 to the disc 1. The tail 6 is fixed to the post component 3 by a securing component 5 placed at the top of said post component 3.

FIG. 2 shows a top view of the disc 1 with the tail 6 attached by the pivot means 2 to the disc 1 at its central vertical axis 7. Also shown in FIG. 2 are two holes 9 in the tail 6 located near the outer edge 10 of the disc 1. Such two holes 9 are for folding or rolling the tail 6 into a compact unit. When so folded or rolled, the tail 6 can be fixed to the upper 8 or lower 11 surface of the disc 1.

FIGS. 2 and 2*a* represent two examples of variations in the shape of the tail 6. FIG. 2 is a tapered tail 6 and FIG. 2*a* is a split tail 6. The tail 6, depending upon variations in its dimensions, will exhibit different flight characteristics.

Figure 4:
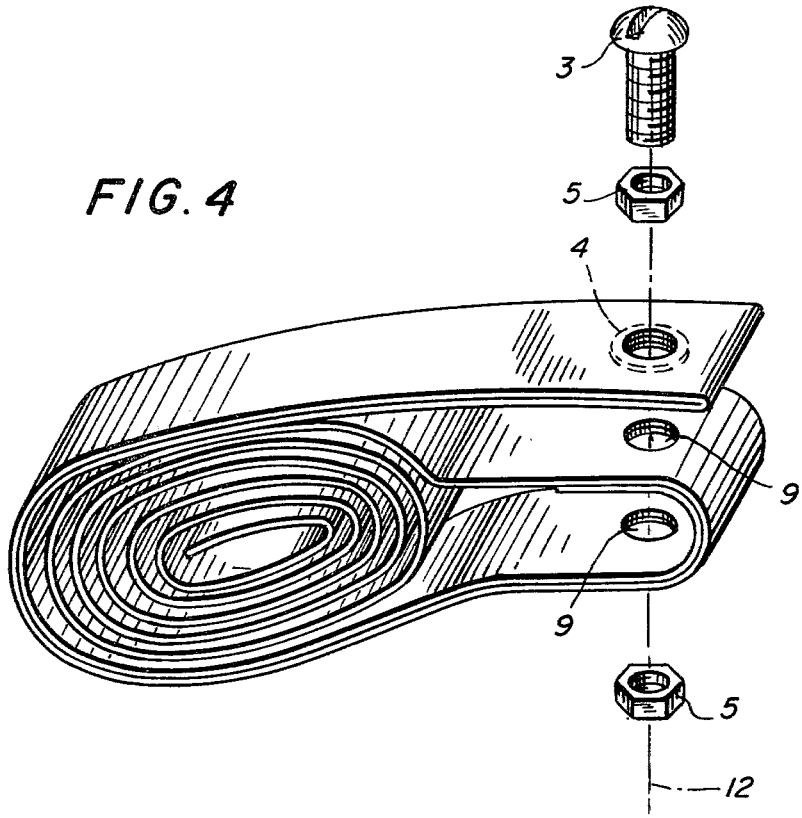

FIGS. 3 and 4 are perspective views of tail 6 in partially folded and partially rolled units, each with an exploded view of the pivot means 2 and its post 3, ring 4, and securing 5 components.

Figure 3A:
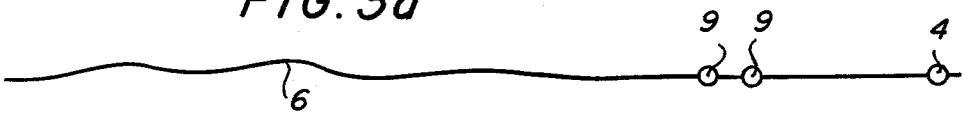
Figure 3B:
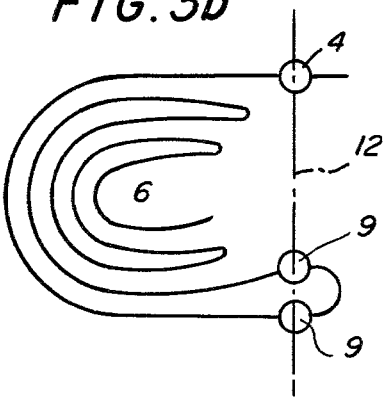
Figure 3C:
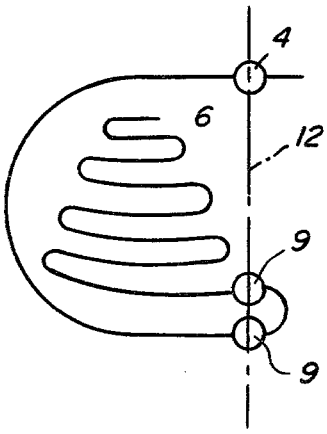
Figure 4A:
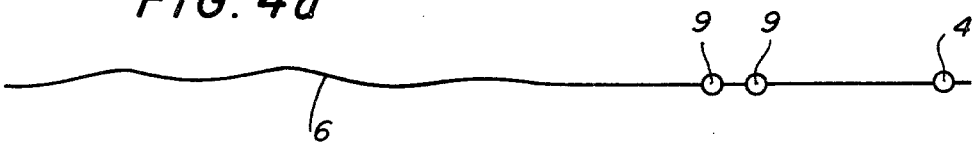
Figure 4B:
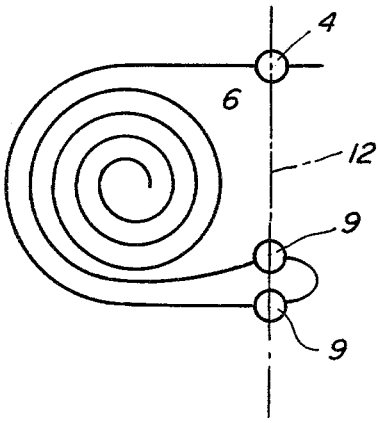
Figure 4C:
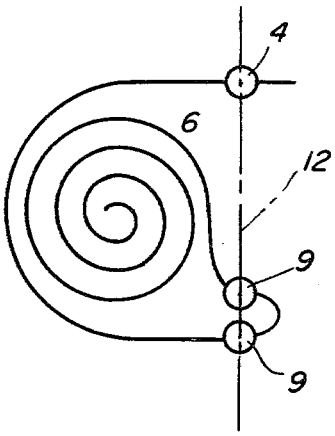

FIGS. 3*a*, *b* and *c* FIGS. 4*a*, *b* and *c* are single line conceptualizations in aid of the description which show the methods of folding and rolling the tail 6 into compact units as depicted in FIGS. 3 and 4, respectively. FIGS. 3*a* and 4*a* show conceptually the tail 6 and its three elements; the ring component 4 of the pivot means 2, the two holes, 9, and the tail 6, including at least one streamer 6. The dotted lines 12 in FIGS. 3, 3*b* and *c* and FIGS. 4, 4*b* and *c* represent the path which the post component 3 of the pivot means 2 will follow when inserted through the two holes 9 and ring component 4 for folding or rolling the tail 6 into a compact unit for convenience or storage.

What is claimed:

1. An aerial toy comprising a flying saucer disc, a flexible tail, and pivot means for attaching one end of said flexible tail to said disc at the central vertical axis to allow the disc to rotate about the axis relative to said one end of the flexible tail, such that when the flying saucer disc is rotating in flight the flexible tail trails the disc in the direction opposite to the direction of flight, said pivot means including a first aperture in said tail adjacent said one end and a connector receivable in said aperture, said tail having means for securing it in folded or rolled condition, said latter means including other apertures longitudinally spaced from said first aperture, said connector being receivable in said other apertures to secure the tail in folded or rolled condition.

2. An aerial toy in accordance with claim 1 wherein said flexible tail has at least one streamer whose length is at least ten times greater than its maximum width, said at least one streamer being at least ten inches in length.

3. An attachment for an aerial toy comprising a flexible tail including is at least ten times greater than its maximum width, said flexible tail being at least 10 inches in length, and pivot means able to be secured at one end of the flexible tail for attachment at the central axis of the flying saucer disc to allow said disc to rotate in its flight with said flexible tail remaining extended in a direction opposite to the direction of flight, said pivot means including a first aperture in said tail adjacent said one end and a connector receivable in said aperture, said tail having means for securing it in folded or rolled condition, said latter means including other apertures longitudinally spaced from said first aperture, said connector being receivable in said other apertures to secure the tail in folded or rolled condition.

4. An attachment in accordance with claim 3 wherein said pivot means includes a post for extension through a hole in the flying saucer disc at its central vertical axis, and means for securing said post in said hole wherein securing means fixes said attachment at one end of said attachment to said post and said post to said disc, to allow said disc to rotate about said axis relative to said one end of said attachment.

* * * * *

UNITED STATES PATENT AND TRADEMARK OFFICE

CERTIFICATE OF CORRECTION

PATENT NO. : 4,209,936

DATED : July 1, 1980

INVENTOR(S) : Paul R. Sklar

It is certified that error appears in the above—identified patent and that said Letters Patent is hereby corrected as shown below:

Column 1, line 27, "osciliate" should read -- oscillate as --.

Column 3, line 6, after "tail" delete the remaining of the line and insert therefor: -- including at least one streamer having a length which is at least ten times greater. --

Signed and Sealed this

*First* Day of *September 1981*

[SEAL]

*Attest:*

GERALD J. MOSSINGHOFF

*Attesting Officer*

*Commissioner of Patents and Trademarks*